United States Patent [19]

Füsser

[11] 4,419,878

[45] Dec. 13, 1983

[54] HYDRAULIC DROP FORGING PRESS OF ABOVE-CONSTRUCTION WITH PRESTRESSED PRESS FRAME

[75] Inventor: Hermann Füsser, Haan, Fed. Rep. of Germany

[73] Assignee: SMS Schloemann Siemag Aktiengesellschaft, Dusseldorf, Fed. Rep. of Germany

[21] Appl. No.: 295,082

[22] Filed: Aug. 21, 1981

[30] Foreign Application Priority Data

Aug. 28, 1980 [DE] Fed. Rep. of Germany ..... 3032355

[51] Int. Cl.[3] ..... B21J 9/02

[52] U.S. Cl. ..... 72/455; 72/453.01; 72/456

[58] Field of Search ..... 72/455, 453.01, 453.18, 72/456, 417; 100/214, 269

[56] References Cited

U.S. PATENT DOCUMENTS 2,582,889 1/1952 Sedgwick ..... 100/214
2,594,204 4/1952 Nowak ..... 72/441
2,730,981 1/1956 Ernst ..... 72/417
3,892,122 7/1975 Snell ..... 72/453.18

FOREIGN PATENT DOCUMENTS 940871 11/1963 United Kingdom ..... 72/455

OTHER PUBLICATIONS

"Hydraulic Presses and Hydraulic Pressure Systems", Ernst Muller, vol. 1, "Forging Presses", 3rd Ed. 1962 Springer-Verlag pp. 32–34 and 58–65.

*Primary Examiner*—Gene Crosby
*Attorney, Agent, or Firm*—Holman & Stern

[57] ABSTRACT

A hydraulic drop forging press has a prestressed frame comprising vertical columns and crossheads. A stationary piston is mounted on an upper crosshead and the press tool is carried by a moving cylinder. The cylinder is guided in a stationary upper guide mounted in the intermediate crosshead, and lower guides on the cylinder are guided on the columns.

7 Claims, 5 Drawing Figures

HYDRAULIC DROP FORGING PRESS OF ABOVE-CONSTRUCTION WITH PRESTRESSED PRESS FRAME

BACKGROUND OF THE INVENTION

1. Field of the Invention

The invention relates to a hydraulic drop forging press of above-floor construction, comprising a prestressed press frame consisting of a lower crosshead and upper crosshead with columns which connect these together and which are prestressed against compression supports disposed between the inner sides of the crossheads.

2. Description of the Prior Art

Hydraulic forging presses of above-floor and below-floor construction based on the principle of combined plunger and column guiding are known. In these, the press plunger, which slides in a cylinder in the upper cylinder crosshead, is guided therein by means of a liner. In addition, a moving crosshead which is rigidly fixed to the plunger is guided on the columns which connect together the cylinder crosshead and lower crosshead. By virtue of this rigid connection between the plunger and the moving crosshead, the total moment exerted by the pressing force can be transmitted to the plunger, and must in such a case be absorbed by the liner in the cylinder. This causes heavy wear of the guide liner and can lead to scoring of the plunger and to leaking of the packing.

This and other methods of guiding the moving crosshead and plunger in forging presses are known from the literature (see Ernst Müller, "Hydraulic Presses and Hydraulic Pressure Systems", volume 1: "Forging Presses", 3rd edition 1962, Springer-Verlag, pages 32 to 34 and 58 to 65, but in particular page 62). This states that in the case of single cylinder presses with the plunger fixed into the moving crosshead, a column guide system can no longer be used alone, because the plunger opposes any inclination of the crosshead, and in the case of eccentric forging, contact pressure is also transmitted to the cylinder liner. As stated heretofore, this leads to increased wear, the result of which is often gland leakage.

The drawback of all these types of construction is that cylinder liners which are used as guide elements are subjected to heavy wear, and the dust resulting from the abrasion is picked up by the operating medium. If this state is improved by using an articulated support for the piston or plunger, the latter is no longer used for guide purposes. The liner is then no longer subjected to wear as in the case of a rigid connection between the plunger and moving crosshead. Because of the fact that in this case only the moving crosshead is guided on the columns, a constant guide distance is now obtained, which is defined by the guide length or overall height of the moving crosshead.

BRIEF SUMMARY OF THE INVENTION

The object of the invention is therefore to provide a drop forging press which does not have these drawbacks with respect to the guides, and in which wear due to eccentricity is provided without reduction of guidance to short guide lengths.

According to the present invention there is provided a hydraulic drop forging press of above-floor construction, comprising a prestressed press frame consisting of a lower crosshead, guide crosshead and upper crosshead with columns which connect these together, and which are prestressed against compression supports disposed between the inner sides of the crossheads, and further comprising a piston provided in a fixed manner on the upper crosshead and facing downwards, and a movable cylinder cooperating with the piston and carrying the upper press die on the cylinder base, characterized in that the externally round cylinder is guided in a fixed adjustable round guide in the guide crosshead, and a further guide in the form of a flat guide is formed at the cylinder base, and is supported on the compression supports of the columns.

Also according to the invention there is provided an above-floor drop-forging press comprising a lower crossheaad, an upper crosshead, a guide crosshead between the lower and upper crossheads, columns interconnecting the said crossheads, compression abutments disposed between respective mutually opposed surfaces of the crossheads prestressing means disposed to prestress the said crossheads against one another and against the compression abutments whereby the said crossheads and columns form a prestressed press frame, a downwardly facing piston mounted on the upper crosshead, a vertically movable hydraulic cylinder enclosing the said piston, the said cylinder having a lower end region adapted to carry an upper forging die, movable lower guide means associated with the cylinder lower end region guiding the cylinder lower end region relative to the said columns, and upper guide means guiding the cylinder in the guide crosshead and comprising a stationary guide in the guide crosshead in guiding engagement with the said cylinder.

The upper guide is preferably round, in particular circular. Alternatively however an upper flat guide could be used. The lower guide is preferably a flat guide.

The moving crosshead used in normal press constructions is thus replaced by a mobile cylinder. The cylinder is guided in the guide crosshead and on the compression support of the prestressed columns between the guide crosshead and lower crosshead; these compression supports are of angular form. As a result, as the cylinder descends the guide distance between the fixed adjustable preferably circular guide in the guide crosshead and the flat guide on the columns becomes greater. This increase in the guide distance during the pressing operation substantially aids the removal of load from the guides even in the case of eccentric forces. Eccentric forces which arise during pressing are supported in the circular guide in the guide crosshead and on the angular compression supports for the columns. The rigidity of the press is also improved, as the upper circular guide is seated in the fixed guide crosshead and the lower guide is supported in the compression supports.

The gland and basic liner between the fixed piston and moving cylinder do not take part in the guiding operation, as they move centrally within the circular guide of the stationary guide crosshead. The advantage of the circular guide is that the cylinder is disposed exactly centrally with respect to the piston, and the center cannot be varied owing to the adjustment of the circular guide.

The adjustable flat guides at the level of the cylinder base, which during forging are disposed in the vicinity of the hot workpiece, are preferably so designed that heat expansion leads to no blockage in the guide.

BRIEF DESCRIPTION OF THE DRAWINGS

One example of the invention is described hereinafter with reference to the accompanying drawings, wherein.

DETAILED DESCRIPTION

Figure 1:
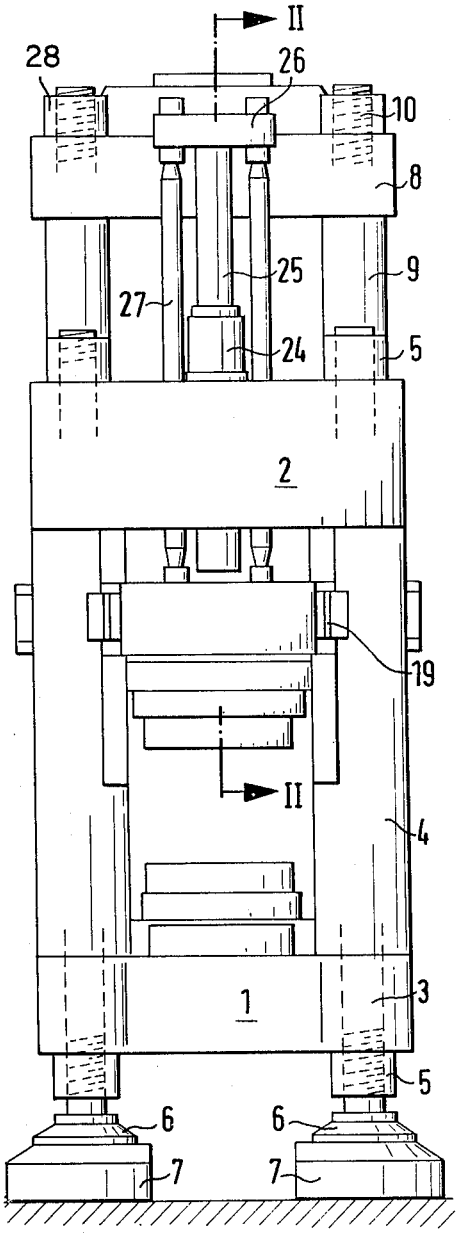
FIG. 1 is an elevational view of a single cylinder hydraulic drop forging press for large pressing forces.
Figure 2:
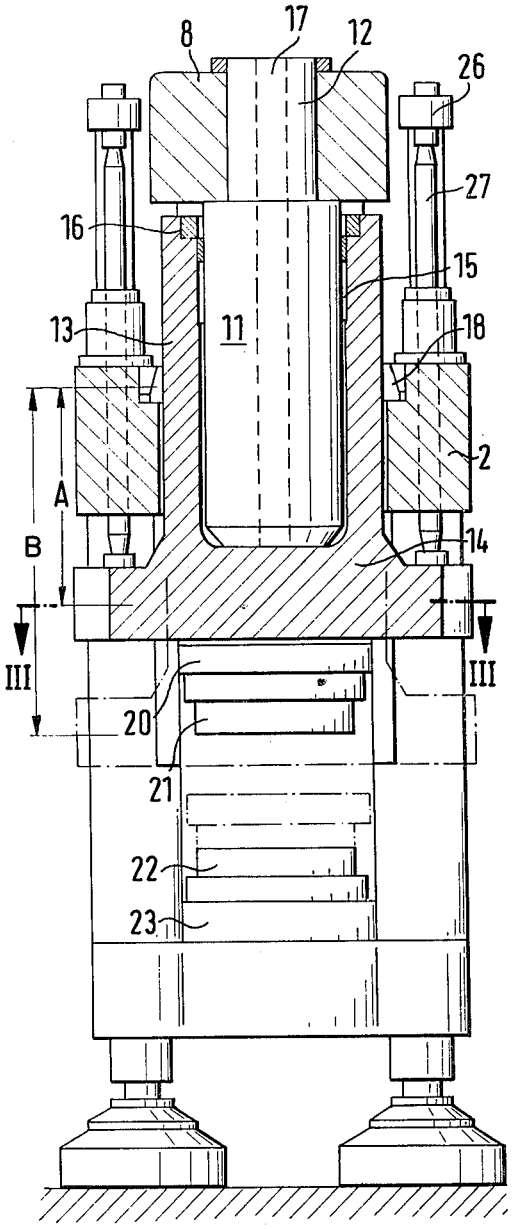
FIG. 2 is an elevational view of the same press taken in partial section on the line II—II of FIG. 1.
Figure 3:
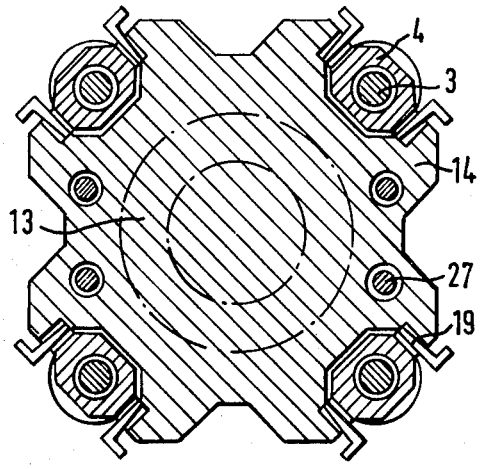
FIG. 3 is a cross sectional view through the cylinder base of the press comprising adjustable flat guides, taken on the line III—III of FIG. 2.
Figure 5:
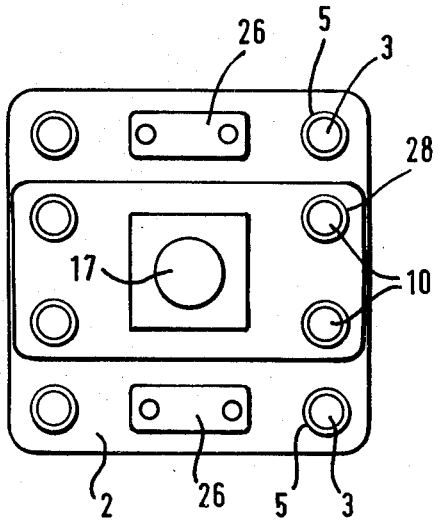
FIG. 5 is a top plan view of the press as shown in FIG. 1.
Figure 4:
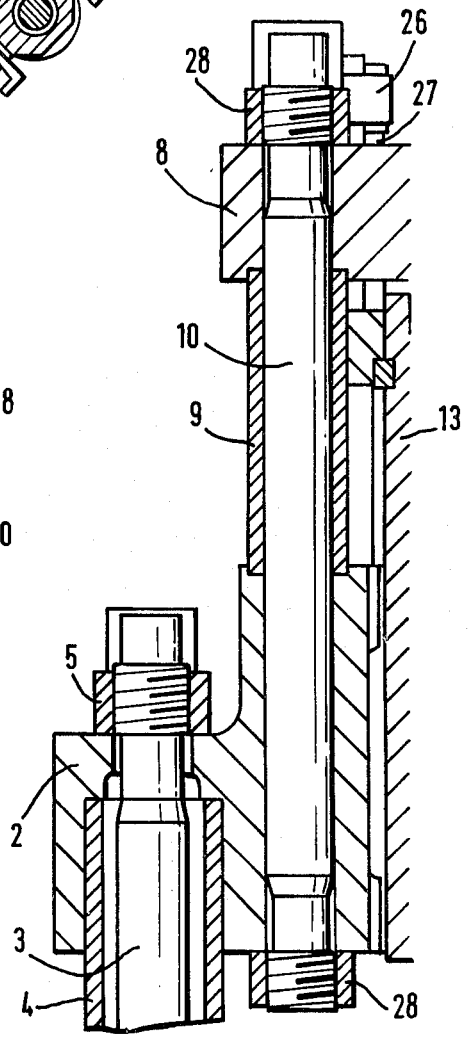
FIG. 4 is a partial cross-sectional view of an upper portion of the press.

The illustrated single cylinder hydraulic drop forging press, of four-column above-floor construction, consists of a lower crosshead 1 and a fixed guide crosshead 2 disposed above this latter, these being connected together by means of prestressed columns or tie rods 3. The prestressing is attained by means of hollow angular compression supports or abutments 4 between the lower crosshead 1 and guide crosshead 2, which surround the columns 3 and press against the mutually facing inner sides of the crossheads 1 and 2, the columns 3 being stressed against the crossheads 1 and 2 by means of nuts 5.

The lower ends of the columns 3 rest on or in foundation plates 6, which lie on the foundation 7. above the guide crosshead 2 and at a distance therefrom there is disposed an upper crosshead 8 which is connected to the guide crosshead 2 by prestressed columns or tie rods 10, in the same manner as members 3 connect crossheads 1 and 2, which are prestressed by means of further hollow compression supports or abutments 9 between the mutually facing inner faces of crossheads 2 and 8, in the same manner as supports 4 between crossheads 1 and 2, the prestressing force being applied by nuts 28 threadedly engaging the ends of columns 10.

A downwardly facing piston 11 together with its rod 12 is rigidly clamped in the upper crosshead 8. A vertically movable cylinder 13 comprising a cylinder base 14 can slide up and down on the piston 11. The cylinder is guided on the piston by means of a cylinder liner 15, and sealing is by means of a gland 16. The hydraulic pressure medium is fed to the cylinder 13 through an axial bore 17 in the piston 11 and piston rod 12. The cylinder 13 has a circular external cross section and its circular periphery is guided in the guide crosshead 2 in an adjustable circular upper guide 18. The cylinder base 14 located below the cylinder 13 extends radially to the compression supports 4, and is guided thereon by lower guide means comprising wedge-shaped adjustable flat guides 19. The flat guides 19 are each disposed in known manner diagonnaly on the four compression supports 4, so that this lower guide means does not become jammed due to heat expansion.

A protection plate 20 is provided below the cylinder base 14. An upper die 21, adjoining the protection plate 20, is fixed to the cylinder base 14. A corresponding lower die 22 is fixed on a table plate 23 on the lower crosshead 1.

Return cylinders 24 are provided in the guide crosshead 2, in which plungers 25 slide. These each carry a cross member 26 connected to the cylinder base 14 by means of tie rods 27, for lifting the cylinder 13.

The distance between the stationary circular upper guide 18 and the lower flat guide 19 when the cylinder 13 is in its upper position is indicated by A. On filling the cylinder 13 with the pressure medium through the bore 17 in the fixed piston 11, the cylinder descends and the guide distance between the upper and lower guides increases, as indicated by B when the cylinder 13 is in its lowest position, in which the upper die 21 lies on the lower die 22. The fact that the guide distance increases as the stroke increases aids the removal of load from the guides during the forging operation, even in the case of eccentric forces, and increases the accuracy of the drop forging operation.

The upper guide may for example comprise inner and outer arcuate segments with part-conical mating surfaces.

Axial movement of the outer segments, mounted in the crosshead, allows lateral adjustment of the circular internal profile of the inner segments relative to the crosshead, to ensure accurate centering of the cylinder in the crosshead. The segments are set in position while the cylinder is stationary, the cylinder being centered by the sleeve or liner 15. During subsequent operation the cylinder is guided by the previously set circular guide and the liner 15 is relieved of guidance loads.

What is claimed is:

1. An above-floor drop-forging press comprising a lower crosshead, an upper crosshead, a guide crosshead between the lower and upper crossheads, columns interconnecting said lower and guide crossheads, columns interconnecting said guide and upper crossheads, compression abutments disposed between respective mutually opposed surfaces of said lower and guide crossheads and said guide and upper crossheads, prestressing means to respectively prestress said columns and said abutments by compressing said abutments between the crossheads so that said crossheads, abutments and columns form a prestressed press frame, a downwardly facing piston mounted on the upper crosshead, a vertically movable hydraulic cylinder enclosing said piston in operable engagement therewith, said cylinder having a lower end region adapted to carry an upper forging die, movable lower guide means operably arranged on said cylinder, lower end region for guiding the cylinder lower end region relative to said columns interconnecting said lower and guide crossheads, and upper guide means guiding said cylinder in the guide crosshead comprising a stationary guide in the guide crosshead in guiding engagement with said cylinder.

2. A forging press as claimed in claim 1 wherein said cylinder has a round external cross sectional profile over at least part of the length of its upper region, and said upper stationary guide has an internal profile matching and in guiding engagement with said round external profile.

3. A forging press as claimed in claim 2 wherein said round profile cross-section is circular.

4. A forging press as claimed in claim 1 wherein said lower guide means comprise flat guides.

5. A forging press as claimed in claim 4 wherein said flat guides comprise wedge-shaped guide members disposed diagonally relative to the cylinder.

6. A forging press as claimed in claim 4 or 5 wherein said compression abutments encircle said columns and said flat guides slidingly engage said abutments, which encircle the said columns interconnecting said lower and guide crossheads.

7. A forging press as claimed in any one of claims 1 to 5 and further comprising at least one further hydraulic cylinder and piston operably connected to said movable cylinder and said guide crosshead for raising said movable cylinder.

* * * * *